US005518281A

United States Patent [19]

Steward

[11] Patent Number: 5,518,281

[45] Date of Patent: May 21, 1996

[54] LOCKER HANDLE AND LATCHING ASSEMBLY

[76] Inventor: Thomas I. Steward, 13 Manhatten Blvd., Islip Terrace, N.Y. 11752

[21] Appl. No.: 170,123

[22] Filed: Dec. 20, 1993

[51] Int. Cl.[6] ..... E05C 1/04

[52] U.S. Cl. ..... 292/145; 292/148; 292/DIG. 68

[58] Field of Search ..... 292/DIG. 31, DIG. 68, 292/104, 205, 137, 145, 147, 148, 152, 336.3

[56] References Cited

U.S. PATENT DOCUMENTS

| | | | |
|---|---|---|---|
| 3,096,113 | 7/1963 | Polzin | 292/147 |
| 3,158,908 | 12/1964 | Springer | 292/DIG. 30 X |
| 3,554,591 | 1/1971 | Rowe | 292/147 X |
| 3,866,961 | 2/1975 | List | 292/148 X |
| 4,335,595 | 6/1982 | Swan et al. | 292/DIG. 31 X |
| 4,438,964 | 3/1984 | Peters | 292/DIG. 31 X |
| 4,573,722 | 3/1986 | Lyng | 292/148 |
| 4,580,818 | 4/1986 | Lyng | 292/148 |
| 4,826,265 | 5/1989 | Hockenberry | 292/148 X |
| 4,882,919 | 11/1989 | Craig | 292/DIG. 31 X |
| 5,000,494 | 3/1991 | Guibleo | 292/DIG. 68 X |

FOREIGN PATENT DOCUMENTS

| | | | |
|---|---|---|---|
| 159111 | 6/1957 | Sweden | 292/148 |

*Primary Examiner*—Steven N. Meyers
*Assistant Examiner*—Suzanne L. Dino
*Attorney, Agent, or Firm*—Simpson & Simpson

[57] ABSTRACT

A locker handle assembly having a recessed mounting receptacle with a bolt mounted thereon for sliding reciprocal movement. The bolt includes a front bar, and a back bar which is connected at one end to one end of the front bar, and at its other end to a point midway between the ends of the front bar. A non-moveable door pull is connected to a sidewall of the mounting receptacle and provides a safe means for opening the locker door and prevents the ability of a combination padlock from being manipulated, while locked, so that the locker can be opened, but still allows access to the back of the padlock for use of a key thereon.

2 Claims, 4 Drawing Sheets

FIG. 1
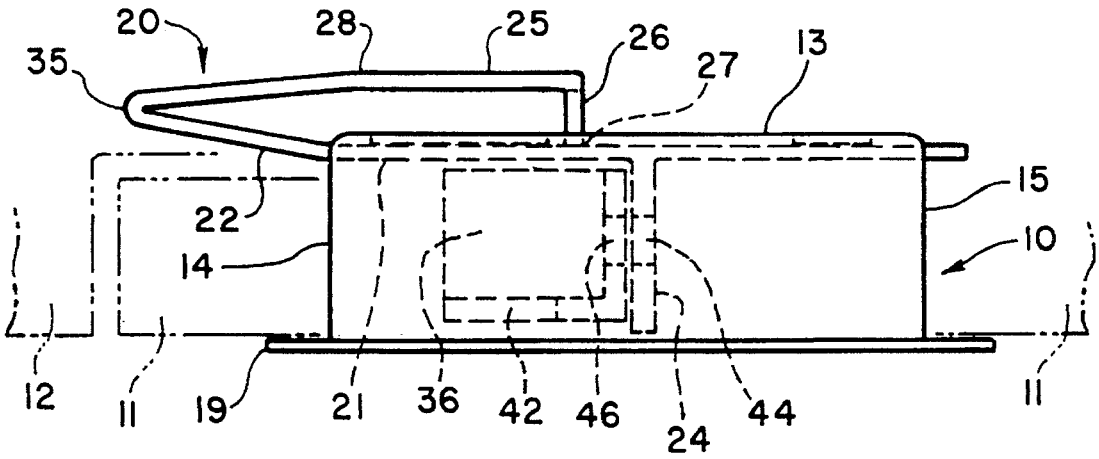
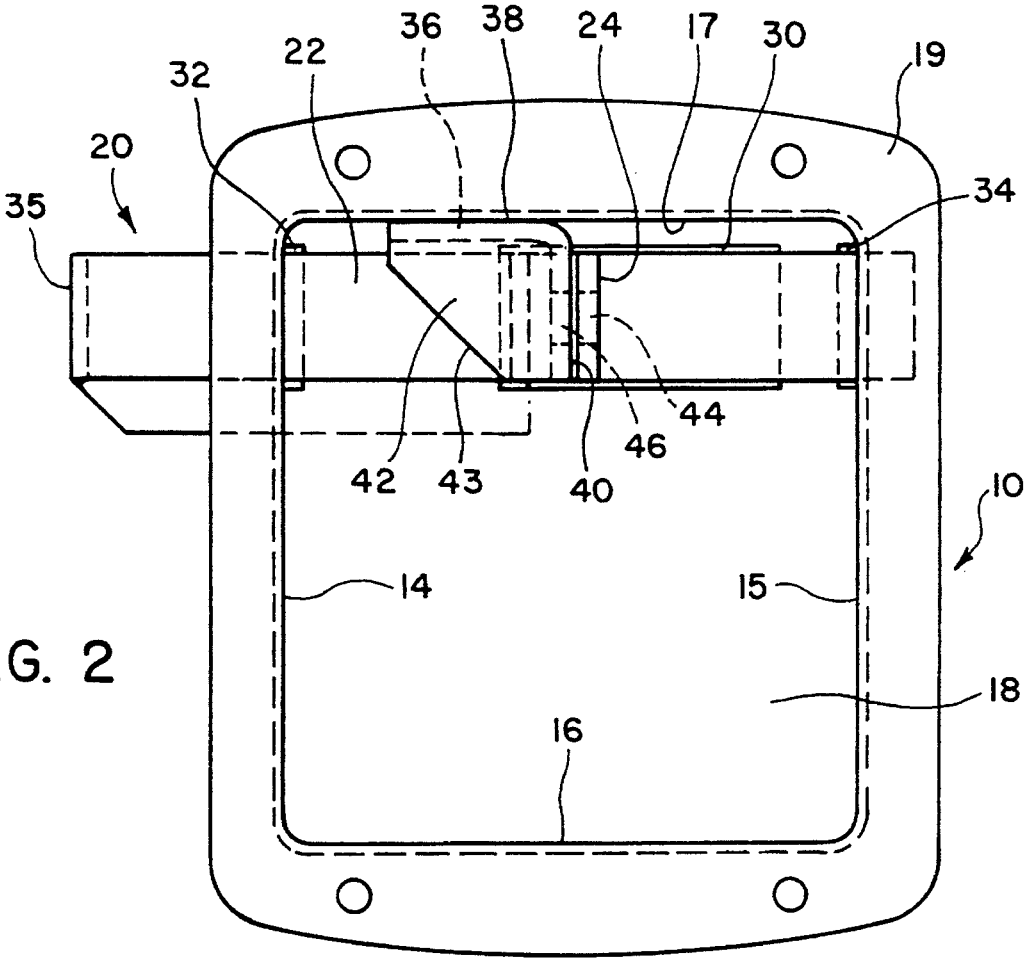
FIG. 2

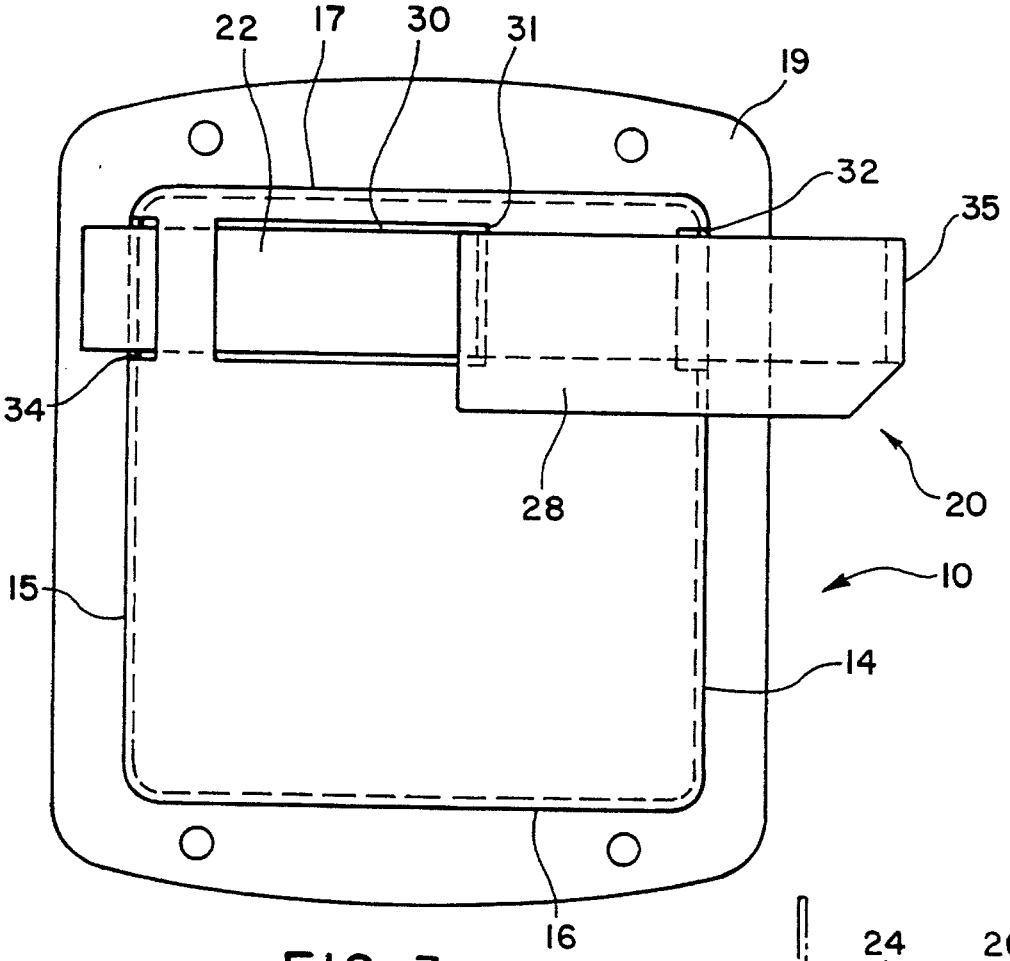
FIG. 3
FIG. 4
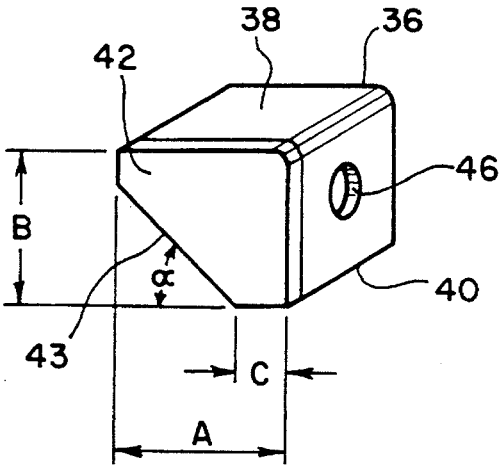
FIG. 5
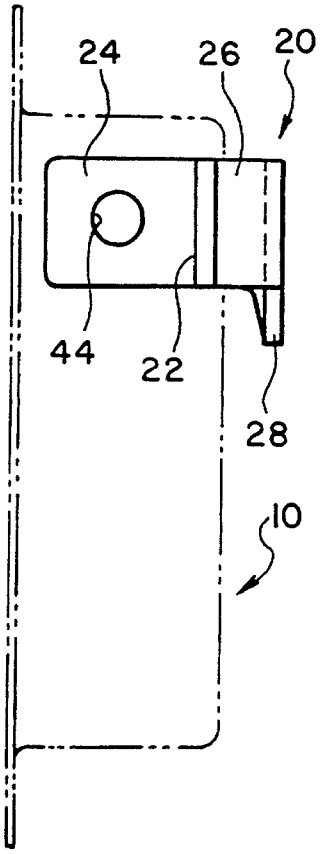

LOCKER HANDLE AND LATCHING ASSEMBLY

BACKGROUND OF THE INVENTION

1. Field of the Invention

This invention relates to the mechanism used in a locker handle assembly of the type generally used in storage lockers found in schools, athletic facilities, airports, train stations, bus terminals and the like.

2. Description of the Related Art

Storage lockers, often referred to as wardrobe lockers, are frequently installed in school facilities and other locations such as athletic facilities, airports, train stations and bus terminals, for the purpose of providing a compact and safe place to temporarily store belongings. Numerous systems have been developed for locking the storage lockers, and generally the locker mechanism is combined with a handle of some type to facilitate opening of the locker by the user.

Two common types of locks used with locker handle assemblies are combination padlocks and built-in combination locks. In most instances, either of these locking systems allows the use of a key so that, if necessary, persons who are authorized to enter the lockers may do so without needing to know the combination of the padlock or built-in combination lock. In the case of padlocks, the access for the key is usually located on the back of the padlock, requiring the key user to lift the padlock up and turn it around to use the key.

U.S. Pat. No. 4,573,722 to Lyng (the '722 patent) teaches a locker handle assembly that utilizes a double slide bolt assembly for use in connection with a padlock. The assembly taught by the '722 patent is designed to replace the "three point gravity system" found in many older lockers, and can be used in new lockers or to replace the systems used in existing lockers. It utilizes a "double truss bar", comprising a front bar and a back bar welded together at opposite ends, to provide more strength than a single slide bolt. When two lock receiving apertures are aligned, a padlock can be simultaneously inserted through each, thereby locking the mechanism. A stop pin is also required to limit the movement of the slide bolt to reduce stress on the slide bolt.

The '722 patent also discusses, without providing illustration, the modification of the double slide bolt assembly to allow the use of a built-in combination lock.

While the mechanism of the '722 patent allows manipulation of the lock so that a key access on the back of the padlock can be accessed, it suffers a drawback in that the padlock can be turned sideways in such a manner that the lock receiving apertures can be spread apart, along the length of the long portion of the "U" shaped portion of the padlock, allowing the locker to be opened without removing the padlock. An additional drawback is that modification of the double slide bolt assembly is required in order to be able to use the assembly with a built-in combination lock.

U.S. Pat. No. 4,580,818 to Lyng (the '818 patent) teaches an attempt to remedy some of the above problems by the inclusion of an outwardly extending, substantially U-shaped portion which prohibits manipulation of the lock as described above. A drawback resulting from the remedy taught in the '818 patent is that the added U-shaped portion also prohibits manipulation of the lock to allow access to the key access on the back of the padlock. Accordingly, school officials and others who may need to access the locker without knowing the combination of the lock cannot use the key to gain access, and must, instead take destructive measures to access the locker.

An additional drawback of the '818 patent is that the U-shaped portion, which also serves as a door pull, is a moveable part of the locker handle assembly. Since the U-shaped portion is moveable between left and right positions, if a user inserts his or her finger into the U-shaped portion to pull the locker open, the slide mechanism may move, possibly pinching the users fingers therein.

SUMMARY OF THE INVENTION

It is an object of the present invention to provide a mechanism for a locker handle assembly which enables access to the rear of a padlock attached thereto while simultaneously prohibiting manipulation of the padlock in such a manner that the mechanism can be opened without removal of the padlock.

Another object of the present invention to provide a mechanism for a locker handle assembly which enables access to the rear of a padlock attached thereto while simultaneously prohibiting manipulation of the padlock in such a manner that the mechanism can be opened without removal of the padlock, and which can also be used with a built in combination lock without any modification to the mechanism.

It is an additional object of the present invention to provide a mechanism for a locker handle assembly which enables access to the rear of a padlock attached thereto while simultaneously prohibiting manipulation of the padlock in such a manner that the mechanism can be opened without removal of the padlock, and which can also be used with a built in combination lock without any modification to the mechanism, and which includes a non- moveable door pull portion which alleviates the potential injuries presented by the door pull mechanism of the prior art.

According to the present invention, there is disclosed a locker handle assembly, comprising a recessed mounting receptacle having a rear wall, a plurality of outwardly extending side walls, an open front portion, and a flange extending from said side walls at the open front portion; two longitudinally extending slots, one each located along each of two opposite sides of the receptacle; a rectangular opening in said rear wall between said longitudinally extending slots; and a slide bolt having front and back bars held together in a spaced-apart relationship by connecting one end of each of said front and back bars together and connecting the other end of said back bar to a point approximately midway between the two ends of said front bar, such that the front bar passes through the longitudinal extending slots in front of the rear wall and the back bar passes behind part of the back wall and through the rectangular opening to the point of connection with the front bar, the slide being horizontally reciprocally operable between a latched and unlatched position such that a predetermined portion of the slide bolt moves in a reciprocal fashion behind a locker door frame. In addition, the present invention includes a door pull assembly which prohibits the manipulation of a padlock thereon in a manner which allows opening of the locker when the padlock is in place, but which allows the back of the padlock to be accessed for using a key to open same.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a top plan view of the locker mechanism of the present invention mounted in a locker door (locker door shown in phantom lines).

FIG. 2 is a front elevational view of the locker mechanism of the present invention, showing the mechanism in a latched position.

FIG. 3 is a rear view of the locker mechanism of the present invention, showing the mechanism in a latched position.

FIG. 4 is a perspective view of a door pull assembly, as viewed from the front right side of the locker mechanism of the present invention.

FIG. 5 is a side view of the slide bolt mechanism of the present invention, as viewed from the right side, with the locker cup shown in phantom lines.

DESCRIPTION OF THE PREFERRED EMBODIMENT

Figure 6:
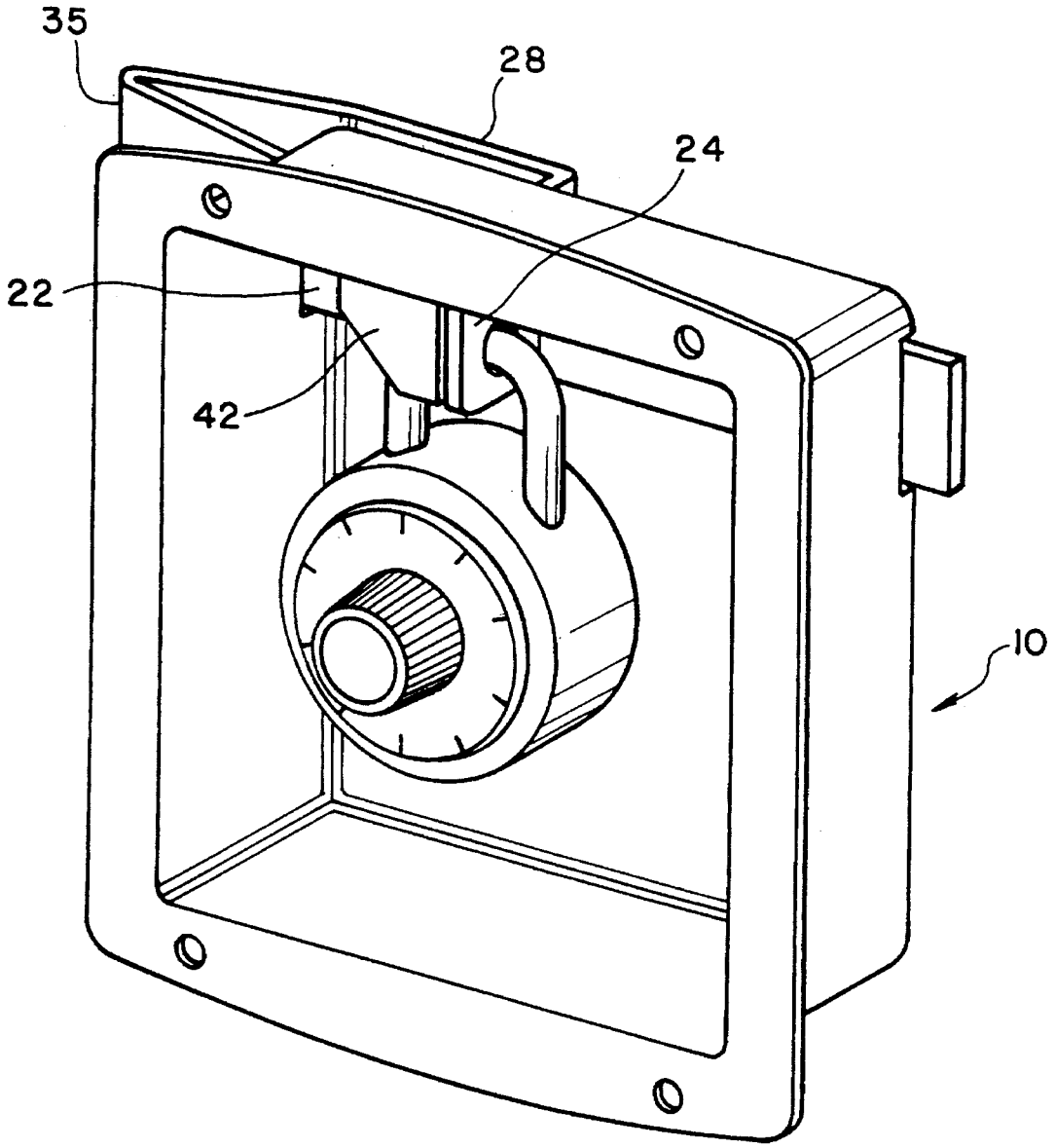
FIG. 6 is a perspective view from the front of the locker mechanism, showing the mechanism in its latched position, locked with a padlock.

Referring to FIGS. 1–6, a recessed mounting receptacle, for example, locker cup 10, is mountable into a locker door 11 (shown in phantom lines in FIG. 1 ) in any suitable manner known in the prior art. Locker door 11 engages with locker frame 12 (shown in phantom lines in FIG. 1 ) when in a closed position. Locker cup 10 has a rear wall 13 and outwardly extending sidewalls 14, 15, 16 and 17, an open front portion 18, and a flange 19. A suitable locker cup is available from Debourgh Manufacturing Company. A slide bolt mechanism 20 is installed into openings 30, 32 and 34 of locker cup 10. Slide bolt mechanism 20 includes a front bar 21 comprising slide bolt bar 22 and slide bolt tab 24, and a rear bar 25 comprising slide bolt stop 26 and built-in combination lock engaging flange 28.

Opening 30 is cut or formed into rear wall 13 and is substantially rectangular in shape, having a length sufficient to allow latching end 35 of slide bolt bar 22 to be moved into and out of engagement with locker frame 12 when locker door 11 is closed. The length of opening 30 defines the limits of travel of the slide bolt bar 22. The width of opening 30 must be sufficient to allow the slide bolt stop 26 to be attached to slide bolt bar 22 at connection point 27, and it should be substantially the same as the width of slide bolt bar 22. To enable attachment of slide bolt stop 26 to slide bolt bar 22 through opening 30, the end of slide bolt stop 26 can be cut to the width of slide bolt bar 22 as shown in FIG. 4.

Openings 32 and 34 can be longitudinal slots cut into each of two opposite sidewalls 14 and 15 of locker cup 10 of sufficient size to allow slide bolt bar 22 to be moved in reciprocal fashion between a latched and unlatched position.

Applicant has found that a suitable slide bolt mechanism can be fabricated by using 8 gauge cold rolled steel for slide bolt bar 22, and fastening thereto, by welding or other fastening means, a piece of 11 gauge cold rolled steel, bent into an L shaped piece to form slide bolt stop 26 and built-in combination lock engaging flange 28. Obviously, variations in the materials and methods used in fabricating the slide bolt mechanism 20 can be resorted to without varying the scope of the present invention. Slide bolt stop 26 is fastened to slide bolt bar 22 to fixedly connect them to each other at connection point 27 approximately midway between the ends of slide bolt bar 22 as shown in FIG. 1. The other end of rear bar 25 is attached to the latching end 35 of slide bolt bar 22.

L-shaped member 36, comprising upper arm 38 and side arm 40, is fastened to the side wall 17 of locker cup 10, as shown in FIG. 2, with side arm 40 being aligned so that it is flush with side 31 of opening 30. Front plate 42 is fastened to L-shaped member 36 as shown in FIGS. 1 and 2. Lock receiving apertures 44 and 46 are formed in slide bolt tab 24 and side arm 40, respectively, providing means for attaching a padlock to the mechanism.

Front plate 42 has a tapered portion 43 which is of a size sufficient to allow a padlock to be lifted up so as to allow access to a key access hole. The tapered portion also prevents, however, the padlock from being turned completely sideways, thereby preventing the slide bolt tab 24 from being moved away from side arm 40 when the padlock is in place. Applicant has found that a front plate having the following dimensions as shown with respect to FIG. 4, is sufficient to carry out this purpose:

Dimension A=1.25 inches

Dimension B=1 inch

Dimension C=0.1875 inches

Angle $\alpha$=45°

The front plate 42, with its tapered portion 43, provides a convenient location for the insertion of a finger to enable the pulling open of the locker door; at the same time, however, there are no moving parts to move in or out of the area where the finger is inserted, thereby resulting in a locker handle with a reduced injury potential over prior art devices.

While the above description discloses the L-shaped member 36 and front plate 42 as a two piece structure as detailed in FIG. 4, a unitary structure formed by, for example, cutting and bending eleven gauge steel to form the same shape as that formed by the two piece construction can be used instead.

As noted above, the prior art devices require the addition of a stop means, which engages with the locker frame to prevent stresses on the slide bolt. The present invention takes care of this problem by the connection of slide bolt stop 26 to slide bolt bar 22. The slide bolt stop 26 prevents movement of the slide bolt beyond the limits imposed by the size of opening 30, thereby removing the need for the inclusion of an additional limiting piece.

Figure 7:
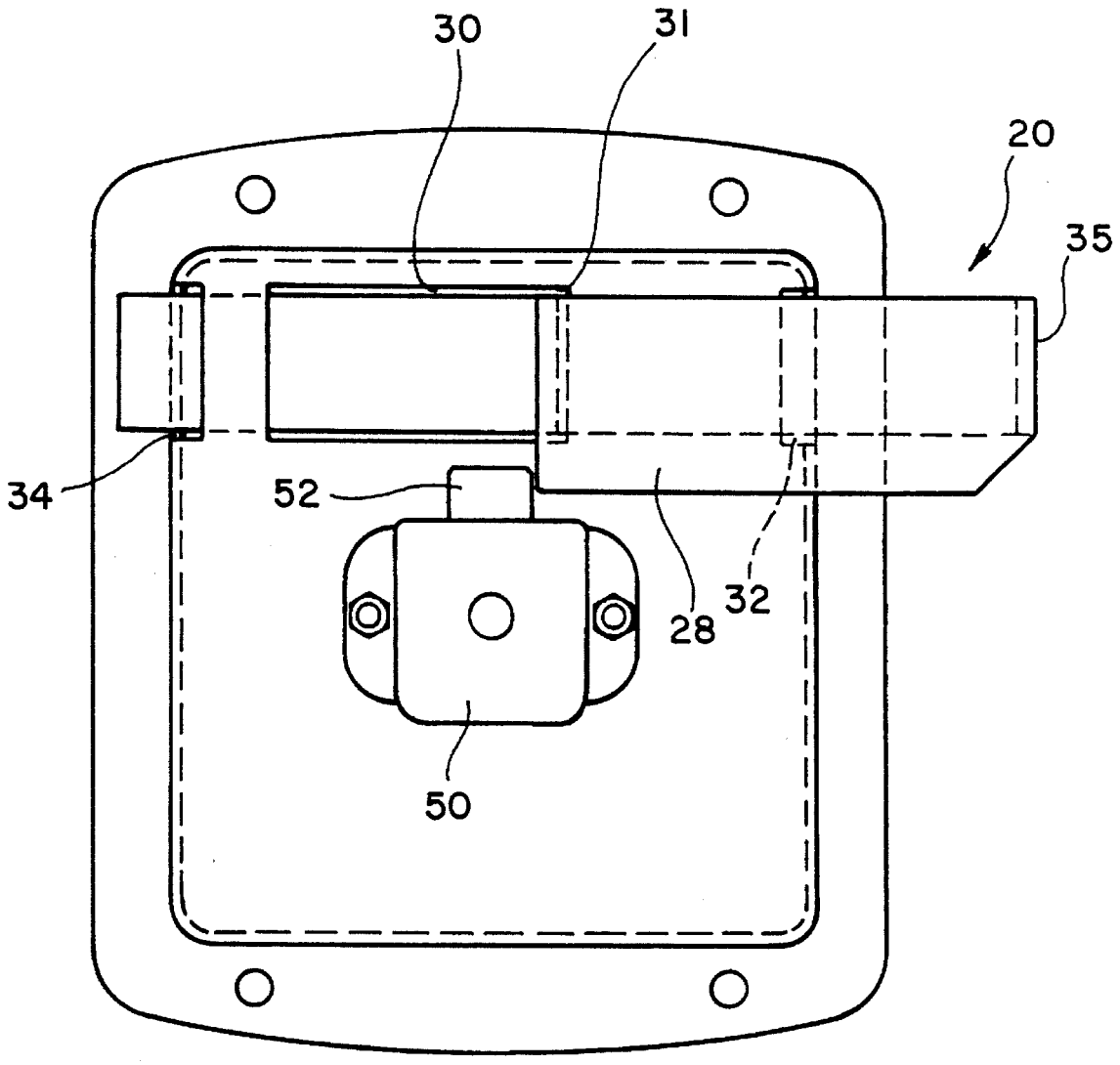
FIG. 7 is a rear view of the locker mechanism of the present invention, showing the mechanism used in connection with a built-in combination lock, in the locked position.

The formation of the slide bolt mechanism 20 as shown also enables the present invention to be utilized with built-in combination locks without the need for modification of the slide bolt mechanism. Built-in combination lock engaging flange 28 provides a flange which, when placed in engagement with the lock tongue 52 of a built-in combination lock 50 as shown in FIG. 7, prevents the movement of the slide bolt mechanism 20. When the correct combination is dialed on the built-in combination lock 50, or when a key is used on same, the tongue 52 is disengaged from the lock engaging flange 28, allowing the locker to open.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A locker handle assembly, comprising:

a recessed mounting receptacle having a rear wall, a plurality of outwardly extending side walls, an open front portion, and a flange extending from said side walls at the open front portion;

two longitudinally extending slots, one each located along each of two opposite sides of the receptacle;

a rectangular opening in said rear wall between said longitudinally extending slots; and a slide bolt having front and back bars held together in a spaced-apart relationship by connecting one end of each of said front and back bars together and connecting the other end of said back bar to a point approximately midway between the two ends of said front bar, such that the front bar passes through the longitudinal extending slots in front of the rear wall and the back bar passes behind part of the rear wall and through the rectangular opening to the point of connection with the front bar, the slide being horizontally reciprocally operable between a latched and unlatched position such that a predetermined portion of the slide bolt moves in a reciprocal fashion behind a locker door frame.

2. A locker handle assembly as set forth in claim 1, wherein one of said outwardly extending side wails is an tipper side wall, and further comprising:

a stationary door pull assembly, comprising:

an L-shaped member, having an upper arm and a side arm, fastened to said upper side wall along said upper arm; and a substantially triangular-shaped front plate having a base, a side, and a hypotenuse, coupled to said L-shaped member so that said tipper arm is flush with said base and said side is flush with said side arm.

* * * * *